US007165468B2

(12) United States Patent
Hirabayashi et al.

(10) Patent No.: US 7,165,468 B2
(45) Date of Patent: Jan. 23, 2007

(54) STARTER

(75) Inventors: Takashi Hirabayashi, Chita-gun (JP); Tsutomu Shiga, Nukata-gun (JP)

(73) Assignee: Denso Corporation, Kariya (JP)

( * ) Notice: Subject to any disclaimer, the term of this patent is extended or adjusted under 35 U.S.C. 154(b) by 601 days.

(21) Appl. No.: 10/752,716

(22) Filed: Jan. 8, 2004

(65) Prior Publication Data

US 2004/0134294 A1 Jul. 15, 2004

(30) Foreign Application Priority Data

Jan. 9, 2003 (JP) ..... 2003-002819

(51) Int. Cl.
*F02N 15/02* (2006.01)

(52) U.S. Cl. ..... 74/7 A; 74/7 E; 290/38 R; 335/131

(58) Field of Classification Search ..... 74/6, 74/7 R, 7 A, 7 E; 335/131; 290/38 R
See application file for complete search history.

(56) References Cited

U.S. PATENT DOCUMENTS 5,111,093 A 5/1992 Tanaka
5,443,553 A 8/1995 Shiga et al.
5,901,604 A * 5/1999 Sato et al. ..... 74/7 A
6,239,503 B1 5/2001 Ikeda et al.
6,763,735 B2 * 7/2004 Siems et al. ..... 74/6
2003/0097891 A1 * 5/2003 Siems et al. ..... 74/6
2006/0117876 A1 * 6/2006 Lepres et al. ..... 74/7 E

* cited by examiner

*Primary Examiner*—David M. Fenstermacher
(74) *Attorney, Agent, or Firm*—Oliff & Berridge, PLC

(57) ABSTRACT

An outer diameter portion of a sealing member is rotatably supported by an inner surface of a nose portion. The axial movement of the sealing member is regulated. A tooth profile-shaped hole having approximately the same shape as that of a gear portion of a pinion is formed in the center of the sealing member. The gear portion of the pinion is constantly fitted into the tooth profile-shaped hole between the position where the pinion is stationary and the maximum moving position of the pinion in an axial direction. Therefore, the gear portion of the pinion cooperatively rotates with the pinion while sliding inside the tooth profile-shaped hole in the sealing member when the pinion moves on an output shaft in the direction opposite to the motor. Even after the gear portion mates with the ring gear, the sealing member cooperatively rotates with the pinion.

13 Claims, 4 Drawing Sheets

STARTER

CROSS REFERENCE TO RELATED APPLICATIONS

This application is based upon, claims the benefit of priority of, and incorporates by reference Japanese Patent Application No. 2003-2819 filed Jan. 9, 2003.

BACKGROUND OF THE INVENTION

1. Field of the Invention

The present invention relates to a starter for starting the operation of an internal combustion engine, more particularly, to a dual-end support type starter in which an end of an output shaft that has a pinion is rotatably supported through a bearing.

2. Description of the Related Art

Japanese Patent Publication No. Hei 7-44811 (1995) and Japanese Patent Laid-Open Publication No. Hei 8-158990 (1996) disclose starters for internal combustion engines. First, the starter described in Hei 7-44811 has a sealing structure as shown in FIG. 8. This sealing structure prevents dust, muddy water, or the like from entering a motor (not shown) through an opening 120 formed through a nose portion 110 of a housing which covers the outer circumference of a pinion 100. The sealing structure is established by fixing a ring-shaped sealing member 130 onto an inner circumference of the nose portion 110 and then bringing an inner diameter portion of the sealing member 130 into contact with an outer circumferential surface of a cylindrical portion 140 provided on the motor side of the pinion 100 in the axial direction (on the left in FIG. 8).

In the starter described in Hei 8-158990, as shown in FIG. 9, a shutter 210 movable in a cooperative manner with a pinion 200 is placed on the side of the pinion 200, the side being opposite (on the left in FIG. 9) to the motor. The shutter 210 closes an opening formed in a nose portion 220 when the starter is stopped, thereby preventing dust, muddy water, or the like from entering the motor through the opening. The shutter 210 moves to the left in FIG. 9 together with the pinion 200 to open the opening when the operation of the starter is started, whereby the pinion 200 and a ring gear 230 can mate with each other.

Each of the starters described in the above-described documents is of the dual-end support type in which the end of the output shaft, which is opposite to the motor, is supported by the end of the nose portion through a bearing. Therefore, it is necessary to form the opening, through which the mating portions of the pinion and the ring gear are exposed, in the nose portion. On the other hand, a single-end support type starter which does not require any opening in a housing has been proposed (see Japanese Patent Laid-Open Publication No. 2000-320438).

In the single-end support type starter, a pinion is attached to an end of an output shaft, which is opposite to a motor. A bearing for supporting the output shaft is provided on the side closer to the motor, in an axial direction, than the pinion. Only the pinion and the end of the output shaft for supporting the pinion, which is opposite to the motor, are exposed through the housing. Since it is not necessary to form any opening in the housing in this structure of the single-end support type starter, dust, muddy water, or the like are unlikely to enter the motor, thereby providing an excellent seal.

However, since the starter described in Hei 7-44811 ensures its sealing function by bringing the sealing member

130 into contact with the cylindrical portion 140 of the pinion 100, it is necessary to set an axial length of the cylindrical portion 140 to be equal to or larger than a movable distance of the pinion in the axial direction. Therefore, the total length of the starter is inevitably increased by the axial length of the cylindrical portion 140, thereby making its installation into a vehicle more difficult or impossible in some instances.

Moreover, the starter includes a clutch 150 that has a larger outer diameter than that of the pinion 100 on the motor side of the pinion 100 in the axial direction (on the left in FIG. 8). The clutch 150 cooperatively moves on an output shaft 160 with the pinion 100. In addition, when the pinion 100 moves to reach the maximum moving position in the axial direction (the position where the pinion 100 mates with a ring gear not shown in the drawing), the clutch 150 enters the moving range of the pinion 100 in the axial direction. Therefore, it is necessary to provide a space 170 for preventing the interference with the clutch 150, inside the nose portion 110. As a result, an inner diameter of the entire nose portion 110 cannot be decreased in accordance with the outer diameter of the pinion 100. Since the maximum outer diameter of the nose portion 110 is increased by the provided space 170, vehicle installation becomes difficult.

In the starter described in Hei 8-158990, at the start of starter operation when the pinion 200 moves on an output shaft 240 in a direction opposite to the motor to mate with the ring gear 230, the shutter 210 naturally opens the opening to prevent the sealing function from acting. Therefore, there is a possibility that dust, muddy water, or the like might enter the motor through the opening.

Moreover, the opening formed in the nose portion 220 has a radial opening face and an axial opening face 250. On the other hand, the shutter 210 is provided in a planar shape sliding in the axial direction because it is necessary to avoid the collision against the ring gear when the shutter 210 moves on the output shaft 240 together with the pinion 200 in a direction opposite to the motor. As a result, when the starter is stopped, the shutter 210 can close only the radial opening face but not the axial opening face 250 as shown in FIG. 9. Therefore, there is a possibility that dust, muddy water, or the like might enter through the axial opening face 250 to penetrate into the motor, which means that sealing is insufficient.

The starter described in Japanese Patent Laid-Open Publication No. 2000-320438 is of the single-end support type without any opening in the housing. Since it has a different structure from that of the dual-end support type described in Hei 7-44811 and Hei 8-158990, they cannot be compared with each other in the same manner. However, since the single-end support type starter has a longer total length than that of the dual-end support type starter in view of structure, this type is disadvantageous in terms of mounting it in a vehicle.

SUMMARY OF THE INVENTION

In view of the above-described problems, the present invention has an object of providing a dual-end support type starter with an improved seal for preventing dust, muddy water, or the like from entering a motor, without increasing the total length of the starter.

(First Aspect)

In a first aspect, a starter has a housing for rotatably supporting an end of an output shaft, the end being on a side opposite to a motor. The housing has a nose portion for covering an outer circumference of a pinion at least within a moving range of the pinion in an axial direction and an opening formed in the nose portion for allowing the pinion to mate with a ring gear. A sealing member has a tooth profile-shaped hole having approximately the same shape as a tooth profile of the pinion, while an outer diameter portion of the sealing member is rotatably supported by an inner surface of the nose portion. A gear portion of the pinion is inserted into the tooth profile-shaped hole so that the sealing member rotates cooperatively with the pinion, wherein the gear portion of the pinion slides on an inner side of the tooth profile-shaped hole of the sealing member when the pinion moves on the output shaft in the direction away from the motor. The gear portion of the pinion is constantly fitted into the tooth profile-shaped hole between a stationary position (when the starter is stopped) and the maximum moving position in the axial direction of the pinion.

According to this structure, the gear portion of the pinion is fitted into the tooth profile-shaped hole formed in the sealing member, whereby a gap between the outer circumference of the gear portion and the inner surface of the nose portion can be sealed by the sealing member. Moreover, since the gear portion of the pinion is constantly fitted into the tooth profile-shaped hole between the stop of the starter (the position at which the pinion is stationary) and the start of operation of the starter (the maximum moving position of the pinion), the sealing function can be constantly provided regardless of the operating state of the starter. Therefore, dust, muddy water, or the like can be prevented from entering the motor through the opening.

Furthermore, since the gear portion of the pinion is fitted into the tooth profile-shaped hole to provide the sealing function, it is not necessary to provide the cylindrical portion for realizing the sealing structure described in Hei 7-44811 on the motor side of the pinion (the gear portion) in the axial direction. Since the cylindrical portion provided for the starter described in the Hei 7-44811 is required to have a length equal to or larger than the axial movable distance of the pinion, the total length of the starter is reduced by omission of the cylindrical portion, resulting in improved vehicle mountability.

(Second Aspect)

In the starter recited in the first aspect, the sealing member has a cylindrical portion projecting toward the ring gear in the axial direction. The tooth profile-shaped hole is formed in the cylindrical portion. In the case, where an end face of the cylindrical portion on the ring gear side in the axial direction is referred to as an A end face, and an end face of the pinion on the ring gear side in the axial direction is referred to as a B end face, when the starter is stopped, the A end face is situated at approximately the same position in the axial direction as that of the B end face or it is situated closer to the ring gear in the axial direction than the B end face.

According to this embodiment, in the state where the starter is stopped, that is, at the position where the pinion is stationary, the outer circumference of the gear portion of the pinion, projecting beyond the tooth profile-shaped hole formed in the sealing member toward the ring gear in the axial direction, is covered with the cylindrical portion of the sealing member, which projects toward the ring gear in the axial direction. Therefore, direct water that splashes over the gear portion can be reduced, whereby dust, muddy water, or the like entering the motor can be further reduced.

(Third Aspect)

In the starter according to the first or second aspect, a contact face coming in contact with an outer circumferential portion of the sealing member in the axial direction is provided on an inner side of the nose portion. Additionally, convex and concave fitting portions, where the contact face and the outer circumferential portion of the sealing member are fitted with each other, are provided on the contact face and the outer circumferential portion of the sealing member for their entire circumferences. In this structure, since a labyrinth structure can be formed by the convex-concave fitting portions between the contact face of the nose portion and the outer circumferential portion of the sealing member, the sealing is improved.

(Fourth Aspect)

In the starter recited in any one of the first to third aspects, the pinion has a collar portion having a larger diameter than that of the gear portion on the motor side of the gear portion in the axial direction. The collar portion rotates and axially moves cooperatively with the pinion. The nose portion has such a cylindrical shape that its inner surface shape, at least within an axial moving range of the collar portion, has an inner diameter slightly larger than an outer diameter of the collar portion. A through hole for bringing the inside and the outside of the nose portion in communication with each other is provided through the nose portion at a position within the axial moving range of the collar portion and in approximately the same direction, that is, orientated vertically with respect to the ground, when the starter is mounted within a vehicle.

According to this structure, if dust, muddy water, or the like ever enter the housing through a gap at the position where the tooth profile-shaped hole in the sealing member and the gear portion of the pinion are fitted, the dust, muddy water, or the like can be prevented from further penetrating into the motor by the collar portion provided on the motor side of the gear portion in the axial direction. Additionally, since the dust, muddy water, or the like can be externally exhausted through the through hole provided in the nose portion, excellent starter sealing can be realized.

(Fifth Aspect)

In the starter recited in any one of the first to third aspects, the pinion has a movable portion, which has a smaller outer diameter than that of the gear portion on the motor side of the gear portion in the axial direction, and which rotates and axially moves cooperatively with the gear portion. The pinion includes the movable portion that independently moves on the output shaft when the internal combustion engine is started, that is, when the starter is activated.

In this structure, since the outer diameter of the gear portion corresponds to the maximum outer diameter of the entire pinion (including the movable portion), the inner diameter of the nose portion can be minimized in accordance with the outer diameter of the gear portion of the pinion at least within the axial moving range of the pinion. As a result, since the maximum outer diameter of the nose portion can be reduced, mounting within the vehicle is improved.

(Sixth Aspect)

According to a fourth aspect of the invention, the pinion has a movable portion which has a smaller outer diameter than that of the collar portion on the motor side of the collar portion in the axial direction. The collar portion rotates and axially and cooperatively moves with the pinion. The pinion, including the movable portion, independently moves on the output shaft when the internal combustion engine is started.

In this structure, since the outer diameter of the collar portion corresponds to the maximum outer diameter of the entire pinion (including the movable portion), the inner diameter of the nose portion can be formed in accordance with the outer diameter of the collar portion at least within the axial moving range of the pinion. As a result, since the maximum outer diameter of the nose portion can be reduced, mounting within the vehicle is improved.

(Seventh Aspect)

In the starter according to any of the first to sixth aspects, a surface of the sealing member is subjected to a friction coefficient reducing treatment. In this case, since the abrasion of the sealing member can be reduced, the lifetime of the sealing member can be improved. In addition, when the sealing member rotates with the pinion, the effect of reducing torque loss due to friction generated between the outer diameter portion of the sealing member and the inner surface of the nose portion can also be obtained.

(Eighth Aspect)

In the starter according to any of the first to sixth aspects, the sealing member is formed of a material having a low friction coefficient. In this case, since the abrasion of the sealing member can be reduced, the lifetime of the sealing member can be improved. In addition, when the sealing member rotates with the pinion, the effect of reducing torque loss due to friction generated between the outer diameter portion of the sealing member and the inner surface of the nose portion can also be obtained.

(Ninth Aspect)

In the starter according to any of the first to eighth aspects, a gap between the outer diameter portion of the sealing member and the inner surface of the nose portion is filled with a grease.

In this case, when the sealing member rotates with the pinion, torque loss due to friction generated between the outer diameter portion of the sealing member and the inner surface of the nose portion can be reduced. Moreover, since the grease can be provided with the sealing function, the sealing between the outer diameter portion of the sealing member and the inner surface of the nose portion is improved.

(Tenth Aspect)

In the starter recited in any one of the first to ninth aspects, the sealing member is formed so that an axial thickness of the inner diameter portion including a peripheral edge of the tooth profile-shaped hole is smaller than that of the outer diameter portion supported by the inner surface of the nose portion.

In this structure, a small thickness of the inner diameter portion of the sealing member can minimize the friction generated between the tooth profile-shaped hole of the sealing member and the gear portion of the pinion when the pinion moves in the axial direction. In addition, a large thickness of the outer diameter portion of the sealing member ensures the strength of the sealing member.

(Eleventh Aspect)

In the starter recited in any one of the first to tenth aspects, the outer diameter portion of the sealing member is supported by the inner surface of the nose portion through a bearing. In this case, since no sliding friction is generated between the outer diameter portion of the sealing member and the inner surface of the nose portion when the sealing member rotates with the pinion, torque loss can be reduced as compared with a structure in which the outer diameter portion of the sealing member is directly supported by the inner surface of the nose portion.

(Twelfth Aspect)

In the starter according to any one of the first to eleventh aspects, the pinion is fitted by a helical spline on the outer shaft so as to be movable on the output shaft along the helical spline. The pinion is operated by a system in which the pinion is moved in a direction opposite to the motor by a turning force of the motor and the action of the helical spline when the internal combustion engine is started. The pinion has a first conduction circuit for allowing a low current to pass through the motor while the pinion is traveling on the output shaft to finally mate with the ring gear and a second conduction circuit for allowing a high current to pass through the motor after the pinion mates with the ring gear.

In this structure, since a low current is allowed to pass through the motor to keep a rotational speed of the motor low while the pinion is traveling on the output shaft to finally mate with the ring gear, the speed of the pinion moving on the output shaft is also lowered. As a result, the abrasion generated between the tooth profile-shaped hole in the sealing member and the gear portion of the pinion can be reduced, whereby the sealing function can be maintained for a long period of time.

(Thirteenth Aspect)

In the starter according to the twelfth aspect, the starter has a pinion rotation regulating means for regulating the rotation of the pinion before the output shaft is driven by the motor. A low current is permitted to pass through the motor to rotate the output shaft while the rotation of the pinion is being regulated by the pinion rotation regulating means, so that the pinion whose rotation is regulated is moved in the direction away from the motor.

In this structure, since the rotation of the pinion is regulated before the output shaft starts rotating, the pinion does not project by inertia with rotation when the output shaft is driven by the motor. The pinion slowly moves on the output shaft without rotating in accordance with the slow rotation of the motor, at least until the pinion abuts against the ring gear. As a result, the action of the lateral face of the gear portion of the pinion compulsively rubbing against the lateral face of the tooth profile-shaped hole in the sealing member is not generated, at least until the pinion abuts against the ring gear. Accordingly, the abrasion generated between the tooth profile-shaped hole in the sealing member and the gear portion of the pinion can be further reduced, whereby the sealing function can be maintained for a longer period of time.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

(First Embodiment)

Figure 1:
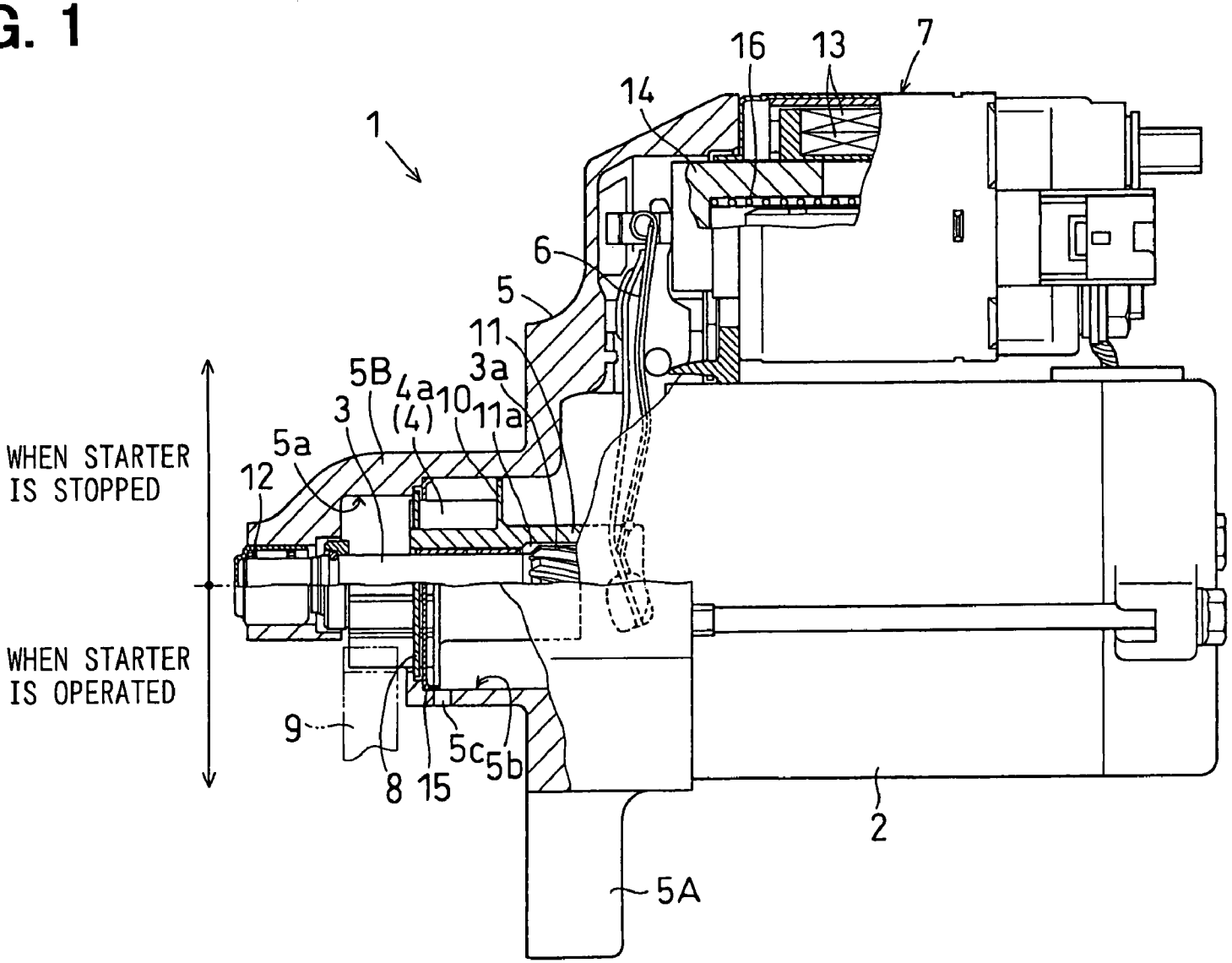
FIG. 1 is a partial cross-sectional view of a starter according to a first embodiment of the invention.

FIG. 1 is a partial cross-sectional view showing a starter 1. The starter 1 in a first embodiment has a motor 2 for generating a turning force, an output shaft 3 driven by the motor 2 to be rotated, a pinion 4 provided on the output shaft 3, a housing 5 for covering outer circumferences of the pinion 4 and the output shaft 3, an electromagnetic switch 7 for turning ON/OFF a conduction current flowing through the motor 2 and for acting to push the pinion 4 via a lever 6 in a direction opposite, that is, away from motor (to the left in FIG. 1), a sealing member 8 fitted to the outer circumference of the pinion 4 to rotate cooperatively with the pinion 4, and the like.

The motor 2 is a DC-motor. When a conduction circuit (not shown) of the motor 2 is closed by the electromagnetic switch 7, power is supplied from an on-vehicle battery so that a turning force is generated by an internal armature (not shown).

The output shaft 3 is placed on the same axis as a rotating shaft (armature shaft) of the motor 2 while being connected to the rotating shaft of the motor 2 through a reduction gear and a clutch (both not shown). Incidentally, the reduction gear may be omitted. On the outer circumference of the output shaft 3, an outer helical spline 3*a* is formed.

The clutch is, for example, a roller type one-way clutch which is frequently used for the starter 1. The clutch transmits the turning force of the motor 2 to the output shaft 3 at the start of operation of an engine. After the start of operation of the engine, the clutch cuts off the transmission of motive power so that the turning force of the engine is not transmitted to the armature.

The pinion 4 includes a gear portion 4*a* which mates with an internal combustion engine ring gear (9) when the engine is started, which is at the beginning of its operation. On the motor side of the gear portion 4*a* in the axial direction, a collar portion 10 and a spline tube 11 (corresponding to a movable portion according to embodiments of the present invention) are integrally provided.

The collar portion 10 is provided in a disk-like form having a larger outer diameter than an outer diameter (tooth-tip diameter) of the gear portion 4*a*. The outer diameter of the collar portion 10 corresponds to the maximum outer diameter as the entire pinion 4.

The spline tube 11 is provided so as to extend in a cylindrical form in the axial direction toward the motor beyond the collar portion 10. An inner helical spline 11*a* formed on the inner side of the spline tube 11 is allowed to mate with the outer helical spline 3*a* of the output shaft 3. An outer diameter of the spline tube 11 is smaller than the outer diameter (tooth-tip diameter) of the gear portion 4*a* and is approximately equal to a tooth-root diameter of the gear portion 4*a*.

The pinion 4 is provided independently on the output shaft 3 (separately from the above-described clutch). At the start of operation of the engine, the pinion 4 independently moves on the output shaft 3.

The housing 5 is provided with a flange portion 5A for allowing attachment to the engine and a nose portion 5B having an approximately cylindrical shape. The nose portion 5B is positioned ahead of the flange portion 5A (in the direction opposite to the motor), and covers the outer circumference of the pinion 4 at least within the axial moving range of the pinion 4. The tip of the nose portion 5B rotatably supports the end of the output shaft 3, which is opposite to the motor, using a bearing 12. The nose portion 5B has an opening, through which the gear portion 4*a* of the pinion 4 is exposed so as to be allowed to mate with the ring gear 9.

An inner surface of the nose portion 5B is formed by a first cylindrical inner surface 5*a* having a slightly larger inner diameter than the outer diameter of the gear portion 4*a* of the pinion 4, and a second cylindrical inner surface 5*b* having a slightly larger inner diameter than the outer diameter of the collar portion 10 of the pinion 4.

The first cylindrical inner surface 5*a* has approximately the same axial length as that of the axial movable range of the pinion 4 in front of the pinion 4 (on the side of the pinion 4, opposite to the motor in the axial direction) which comes to rest at the stop of the starter 1 (at the position above the center line in FIG. 1). The above-mentioned opening is formed on the ring gear side of the first cylindrical inner surface 5*a* in the radial direction.

The second cylindrical inner surface 5*b* has an axial length beyond the axial moving range of the collar portion 10 so as to allow the axial movement of the collar portion 10 of the pinion 4. Moreover, a through hole 5*c*, which brings the inside and the outside of the nose portion 5*b* into communication with each other, is provided in the second cylindrical inner surface 5*b* within the axial moving range of the collar portion 10 and so as to be oriented in approximately the same direction as the direction of the ground when the starter 1 is mounted onto or within a vehicle.

The maximum outer diameter of the nose portion 5B (a diameter of a spigot fitted into an attachment hole provided on the side of the engine in this embodiment) is set at a value obtained by adding a thickness required in view of the strength to the inner diameter of the second cylindrical inner surface 5*b*.

The electromagnetic switch 7 includes a magnetizing coil 13 energized by an ON operation of an ignition key (not shown), and a plunger 14 inserted into the magnetizing coil 13 so as to be slidable inside the magnetizing coil 13. When the plunger 14 is attracted by a magnetic force generated by the energized magnetizing coil 13 (the plunger 14 moves to the right in FIG. 1 inside the magnetizing coil 13), a movable contact point, which is movable with the plunger 14, abuts against a fixed contact point (the movable contact point and the fixed contact point are not both shown) to close the conduction circuit of the motor 2.

The sealing member 8 is a plate-like member having a circular outer circumferential shape. The outer diameter portion of the sealing member 8 is rotatably supported by the inner surface of the nose portion 5B. In addition, the axial movement of the sealing member 8 is regulated by a sealing member fixing component 15.

Figure 3A:
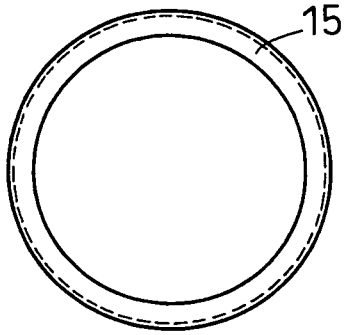
FIG. 3A is a plan view of a sealing member fixing component.
Figure 3B:
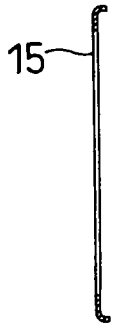
FIG. 3B is a cross-sectional view of the sealing member fixing component of FIG. 3A.

The sealing member fixing component 15 has a ring shape of a small thickness, as shown in FIG. 3. An outer diameter portion of the sealing member fixing component 15 is fixed to the inner surface of the nose portion 5B (the second cylindrical inner surface 5*b*) by pressing or the like. The inner diameter of the ring-shaped portion is set to be larger than the outer diameter (tooth-tip diameter) of the gear portion 4*a*.

Figure 2:
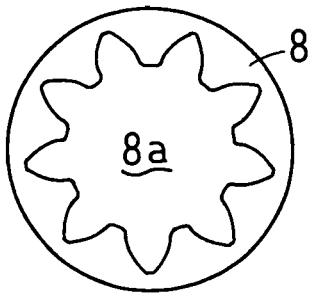
FIG. 2 is a plan view of a sealing member.

A tooth profile-shaped hole 8*a* having approximately the same shape as the tooth profile of the pinion 4 (the tooth profile of the gear portion 4*a*) is formed in the center of the sealing member 8, as shown in FIG. 2. The gear portion 4*a* of the pinion 4 is constantly fitted into the tooth profile-shaped hole 8*a* between the position where the pinion 4 is stationary (when the starter is stopped) and the maximum moving position of the pinion 4 in the axial direction. Therefore, the sealing member 8 cooperatively rotates with the pinion 4 while the gear portion 4*a* of the pinion 4 is sliding inside the tooth profile-shaped hole 8*a* when the pinion 4 moves on the output shaft 3 in the direction opposite, that is, away from motor. Even after the gear portion 4*a* mates with the ring gear 9, the sealing member 8 rotates cooperatively with the pinion 4.

Next, the operation of the starter 1 will be described. When the magnetizing coil 13 of the electromagnetic switch 7 is energized to attract the plunger 14, the movement of the plunger 14 is transmitted to the pinion 4 through the lever 6 connected to the plunger 14. As a result, the pinion 4 moves on the output shaft 3 in the direction opposite to the motor to be pressed against the lateral face of the ring gear 9.

Thereafter, when the conduction circuit of the motor 2 is closed to generate a turning force in the armature, which is in turn transmitted to the output shaft 3, the pinion 4 rotates together with the output shaft 3 to reach the position where the pinion 4 can mate with the ring gear 9. In this manner, the gear portion 4*a* mates with the ring gear 9. As a result, the turning force is transmitted from the pinion 4 to the ring gear 9 to crank the engine.

When the energization to the magnetizing coil 13 is stopped to cancel the magnetic force after the start of operation of the engine, a reaction force of a return spring 16 (see FIG. 1) that biases the plunger 14 pushes back the plunger 14. Therefore, the lever 6 connected to the plunger 14 pivots in the direction opposite to the direction in which the lever 6 pivots at the start of operation of the engine, thereby pulling back the pinion 4. Moreover, since the plunger 14 is pushed back to open the conduction circuit of the motor 2, the electrical conduction to the motor 2 is stopped to stop the rotation of the armature.

Subsequently, the effects according to the present invention will be described. In the above-described starter 1, the gear portion 4*a* of the pinion 4 is fitted into the tooth profile-shaped hole 8*a* formed in the sealing member 8. Therefore, a gap between the outer circumference of the gear portion 4*a* and the inner surface of the nose portion 5B can be sealed by the sealing member 8. Moreover, since the gear portion 4*a* of the pinion 4 is constantly fitted into the tooth profile-shaped hole 8*a* between the stop of the starter (the position where the pinion 4 is stationary) and the start of operation of the starter (the maximum moving position of the pinion 4), the sealing can be constantly maintained regardless of the operating state of the starter 1. As a result, dust, muddy water, or the like can be prevented from entering the motor through the opening formed in the nose portion 5B.

Figure 8:
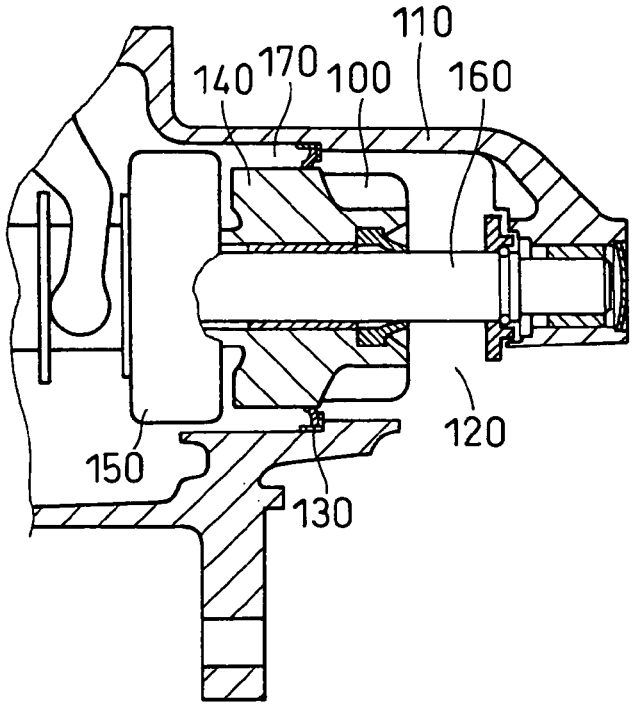
FIG. 8 PRIOR ART
FIG. 8 is a cross-sectional view showing the periphery of a conventional pinion according to Japanese Patent Publication No. Hei 7-44811.

Furthermore, since the gear portion 4*a* of the pinion 4 is fitted into the tooth profile-shaped hole 8*a* formed in the sealing member 8 to provide the sealing function, it is not necessary to provide the cylindrical portion 140 (see FIG. 8) for realizing the sealing structure, described in Hei 7-44811, on the motor side of the pinion 4 (the gear portion 4*a*) in the axial direction. The cylindrical portion 140 provided in the starter described in Hei 7-44811 is required to have a length equal to or larger than the axial movable distance of the pinion 100. On the other hand, according to the structure of this embodiment, since the total length of the starter 1 can be reduced by omission of the cylindrical portion 140, mounting within the vehicle is improved.

Furthermore, the starter 1 has the collar portion 10 on the motor side of the gear portion 4*a* in the axial direction. Additionally, the inner diameter of the second cylindrical inner surface 5*b* of the nose portion 5B is slightly larger than the outer diameter of the collar portion 10. Thus, the sealing function can be provided by the collar portion 10 and the second cylindrical inner surface 5*b*. Therefore, if dust, muddy water, or the like ever enter the nose portion 5B through a gap at the position where the gear portion 4*a* of the pinion 4 is fitted into the tooth profile-shaped hole 8*a* formed in the sealing member 8, the collar portion 10 can prevent the dust, muddy water, or the like from further penetrating into the motor 2. In addition, the dust, muddy water, or the like can be externally exhausted through the through hole 5*c* provided in the nose portion 5B. Accordingly, the starter 1 will exhibit excellent sealing characteristics.

Moreover, the structure of the starter 1 in this embodiment is not such that the clutch moves on the output shaft 3 together with the pinion 4. Instead, the starter 1 has such a structure that the pinion 4 independently moves on the output shaft 3. Therefore, when the starter is started at the beginning of its operation, the clutch, which has a larger outer diameter than that of the collar portion 10, is not placed within the range equal to that of the maximum moving distance of the pinion on the motor side of the collar portion 10 in the axial direction. Therefore, the inner diameter of the second cylindrical inner surface 5*b* formed on the nose portion 5B can be minimized in accordance with the outer diameter of the collar portion 10. Since the maximum outer diameter of the nose portion 5B (in this embodiment, the diameter of the spigot fitted into the attachment hole on the side of the engine) can consequently be reduced, mounting within the vehicle can be improved.

(Second Embodiment)

Figure 4:
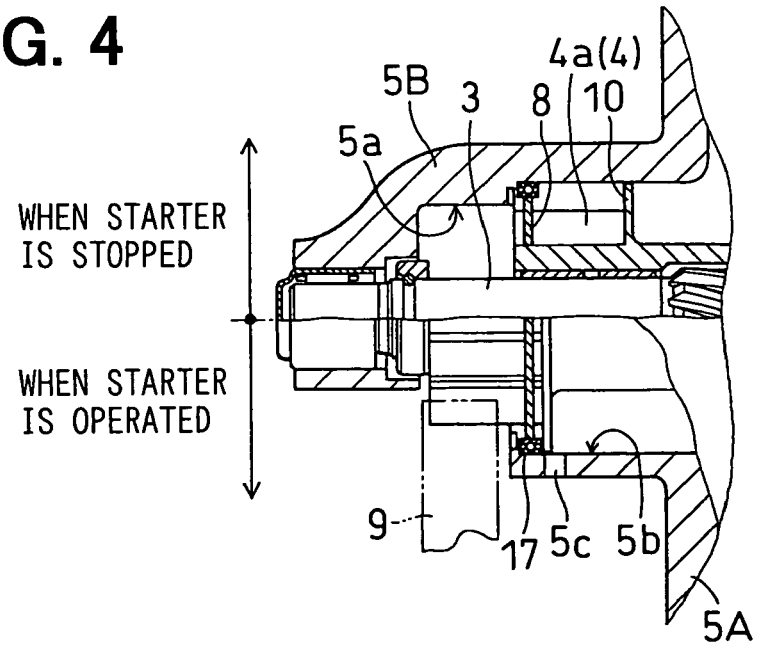
FIG. 4 is a cross-sectional view showing the periphery of the pinion according to a second embodiment.

FIG. 4 is a cross-sectional view showing the periphery of the pinion. This embodiment shows an example where the outer diameter portion of the sealing member 8 is supported by using a bearing 17 as shown in FIG. 4. The bearing 17 is, for example, a ball bearing. An inner ring of the ball bearing 17 is fixed to the outer diameter portion of the sealing member 8, whereas an outer ring thereof is pressed into the second cylindrical inner surface 5*b* so as to be fixed thereto. As a result, since the outer diameter portion of the sealing member 8 is supported by the bearing 17 to block the axial movement thereof, the sealing member fixing component 15 described in the first embodiment is not required here.

According to this structure, the outer diameter portion of the sealing member 8 and the second cylindrical inner surface 5*b* do not come into direct contact with each other when the sealing member 8 rotates with the pinion 4. Accordingly, since sliding friction does not occur between them, torque loss can be reduced as compared with the structure in which the outer diameter portion of the sealing member 8 is directly supported by the inner surface of the nose portion 5B.

The bearing 17 is not limited to the ball bearing. It is apparent that other bearings such as needle bearings and plane bearings can be used as the bearing 17.

(Third Embodiment)

Figure 5:
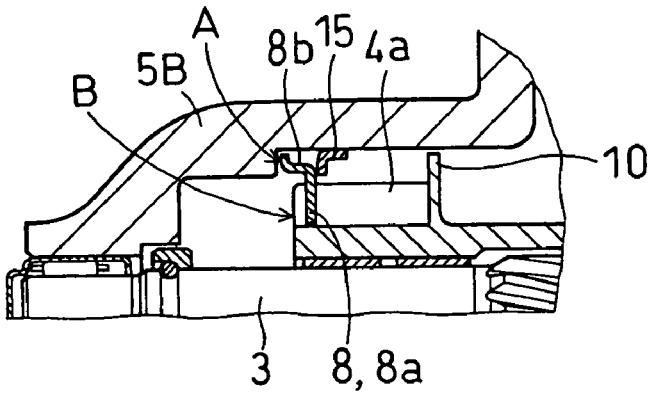
FIG. 5 is a cross-sectional view showing the periphery of the pinion according to a third embodiment.

FIG. 5 is a cross-sectional view showing the periphery of the pinion. The sealing member 8 of this embodiment has a cylindrical portion 8*b* projecting toward the ring gear in the axial direction as shown in FIG. 5. The tooth profile-shaped hole 8*a* is provided through the cylindrical portion 8*b*. An end face of the cylindrical portion 8*b* on the ring gear side in the axial direction is referred to as an A end face, whereas an end face of the pinion 4 (the gear portion 4*a*) on the ring gear side in the axial direction is referred to as a B end face. When the starter is stopped (in a state shown in FIG. 5), the A end face is positioned at approximately the same position in the axial direction as the B end face, or is positioned closer to the ring gear in the axial direction than the B end face.

According to this structure, in the state where the starter 1 is stopped, that is, at the position where the pinion 4 is stationary, the outer circumference of the gear portion 4*a* of the pinion 4, which projects beyond the tooth profile-shaped hole 8*a* of the sealing member 8 toward the ring gear in the axial direction, is covered with the cylindrical portion 8*b* of the sealing member 8. This reduces direct water splash over the gear portion 4*a*. As a result, since dust, muddy water, or the like, which are likely to enter inside through the gap where the gear portion 4*a* of the pinion 4 is fitted into the tooth profile-shaped hole 8*a* in the sealing member 8, can be effectively stopped, sealing can be further improved.

(Fourth Embodiment)

Figure 6:
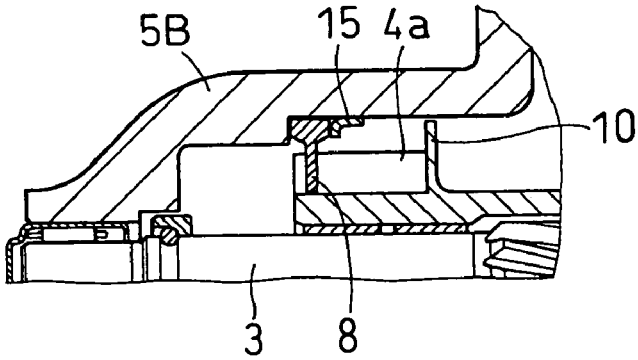
FIG. 6 is a cross-sectional view showing the periphery of the pinion according to a fourth embodiment.

FIG. 6 is a cross-sectional view showing the periphery of the pinion. The sealing member 8 in this embodiment is formed so that an axial thickness of the inner diameter portion including the peripheral edge of the tooth profile-shaped hole 8*a* is smaller than that of the outer diameter portion supported by the inner surface of the nose portion 5B.

According to this structure, the inner diameter portion of the sealing member 8 is formed to be thin, so that the friction, which is generated between the tooth profile-shaped hole 8*a* of the sealing member 8 and the gear portion 4*a* of the pinion 4 when the pinion 4 moves in the axial direction, can be minimized. In addition, the thick outer diameter portion of the sealing member 8 ensures the strength of the sealing member 8.

(Fifth Embodiment)

Figure 7:
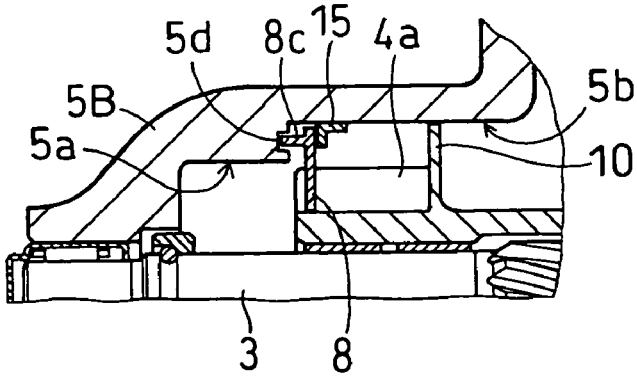
FIG. 7 is a cross-sectional view showing the periphery of the pinion according to a fifth embodiment.

FIG. 7 is a cross-sectional view showing the periphery of the pinion. This embodiment shows an example where a labyrinth structure is formed between the outer circumferential portion of the sealing member 8 and the inner surface of the nose portion 5B. A concave portion (or a convex portion) 5*d* is provided for the entire circumference on, for example, a stepwise face of the nose portion 5B, which is formed between the first cylindrical inner surface 5*a* and the second cylindrical inner surface 5*b*.

On the other hand, a convex portion (or a concave portion) 8*c* is formed for the entire circumference on a surface of the outer circumferential portion of the sealing member 8, the surface being opposed to the stepwise face of the nose portion 5B. The convex portion (or the concave portion) 8*c* on the sealing member 8 is fitted into the concave portion (or the convex portion) 5*d* provided on the stepwise face of the nose portion 5B.

As a result, since the labyrinth structure is formed for the entire circumference by the convex-concave fitting portions where the concave portion (or the convex portion) 5*d* provided on the stepwise face is fitted to the convex portion (or the concave portion) 8*c* provided on the sealing member 8, the seal between the outer diameter portion of the sealing member 8 and the inner surface of the nose portion 5B is improved to effectively prevent dust, muddy water, or the like from entering the motor.

(Embodiment Variation)

The starter 1 described in the first embodiment has such a structure that the pinion 4 moves on the output shaft 3 independently from the clutch. However, the clutch may alternatively be placed on the motor side of the pinion in the axial direction, so that the pinion 4 moves cooperatively with the clutch on the output shaft 3. In this case, however, it is necessary to set the outer diameter of the collar portion 10 to be equal to or larger than the outer diameter of the clutch. If the outer diameter of the collar portion 10 is increased as compared with the case of the first embodiment, the effect of reducing the maximum outer diameter of the nose portion 5B (the diameter of the spigot fitted into the attachment hole on the side of the engine, in this embodiment) cannot be obtained. However, the same effect of improving the sealing as in the first embodiment can be obtained.

Figure 9:
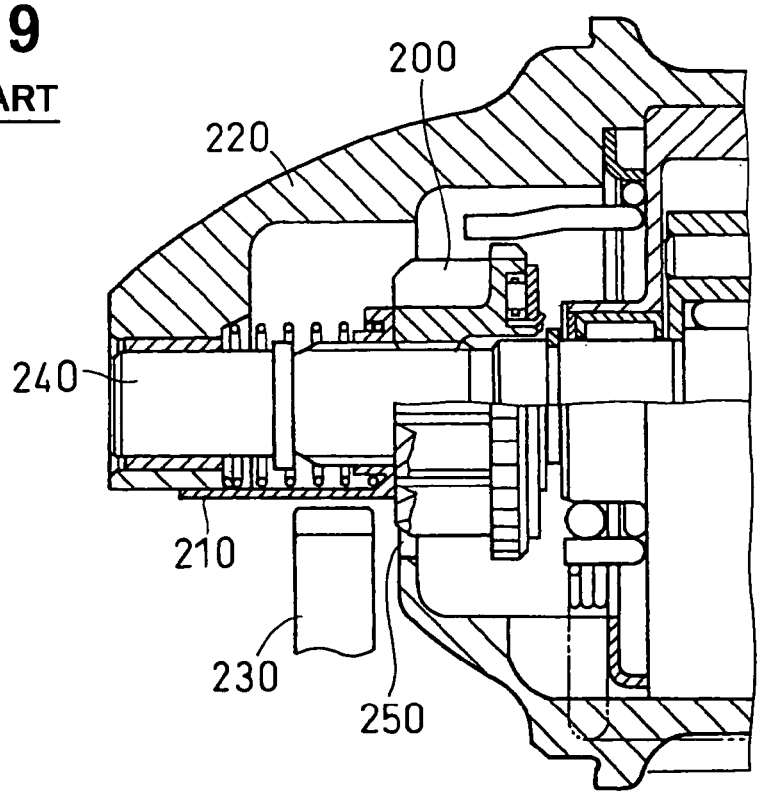
FIG. 9 PRIOR ART
FIG. 9 is a cross-sectional view showing the periphery of a conventional pinion according to Japanese Patent Laid-Open Publication No. Hei 8-158990.

Moreover, the starter 1 described in the first embodiment employs the system in which the pinion 4 is pushed by utilizing an attracting force of the magnetizing switch 7. However, the present invention is also applicable to, for example, a Bendix drive type starter in which the pinion 4 is moved along a helical spline simultaneously with the rotation of the output shaft 3 in accordance with the principle of inertia, or a rotation regulation mating type starter described in Hei 8-158990 (1996) (see FIG. 9; the motor is energized to rotate the output shaft 240 while regulating the rotation of the pinion 200 until the pinion 200 mates with the ring gear 230).

In the above-described Bendix drive type starter, the rotation and the axial movement speed of the pinion 4 can be kept low by reducing the rotational speed of the motor 2 when the pinion 4 moves on the output shaft 3 in the direction opposite to the motor. Therefore, as disclosed in Hei 8-158990, a two-step conduction system is employed. In this system, a low current is allowed to pass through the motor 2 until the pinion 4 mates with the ring gear 9. After the pinion 4 mates with the ring gear 9, a high current is allowed to pass through the motor 2. By employing this two-step conduction, the rotational speed of the motor 2 is kept low while the pinion 4 is moving on the output shaft 3. Therefore, the rotation and the axial movement speed of the pinion 4 are also lowered. As a result, the abrasion, which occurs between the tooth profile-shaped hole 8*a* in the sealing member 8 and the gear portion 4*a* of the pinion 4, can be reduced, thereby allowing the sealing function to be maintained for a long period of time.

In the rotation regulation mating type starter, the pinion 4 moves on the output shaft 3 without being rotated at least until the pinion 4 abuts against the ring gear 9. Therefore, the lateral face of the gear portion 4*a* of the pinion 4 does not rub against the lateral face of the tooth profile-shaped hole 8*a* formed in the sealing member 8, at least not until the pinion 4 abuts against the ring gear 9. Thus, as compared with the Bendix drive type starter employing the two-step conduction system, the abrasion generated between the tooth profile-shaped hole 8*a* in the sealing member 8 and the gear portion 4*a* of the pinion 4 can be further reduced in the rotation regulation mating type starter employing the two-step conduction system. Accordingly, the sealing function can be maintained for a longer period of time.

Moreover, the surface of the sealing member 8 described in the above embodiments may be subjected to a friction coefficient reducing treatment (for example, application of a lubricating coating material, chromium plating, and the like) Alternatively, the sealing member 8 may be formed of a material having a low friction coefficient, for example, a resin containing PTFE (under the registered trademark of Teflon) or the like. In these cases, since the abrasion of the sealing member 8 can be reduced, the lifetime of the sealing member 8 can be improved. At the same time, the torque loss due to the friction generated between the outer diameter portion of the sealing member 8 and the inner surface of the nose portion 5B when the sealing member 8 rotates with the pinion 4 can be reduced.

Moreover, a gap between the outer diameter portion of the sealing member 8 and the inner surface of the nose portion 5B may be filled with a grease. As a result, the torque loss due to the friction generated between the outer diameter portion of the sealing member 8 and the inner surface of the nose portion 5B when the sealing member 8 rotates with the pinion 4 can be reduced. Moreover, since the grease encourages sealing, the sealing is improved between the outer diameter portion of the sealing member 8 and the inner surface of the nose portion 5B.

Although the starter has the collar portion 10 on the motor side of the gear portion 4*a* of the pinion 4 in the axial direction, in the above-described embodiments the collar portion 10 may be omitted. In this case, although the sealing function owing to the collar portion 10 cannot be obtained, the same sealing function provided by the sealing member 8 as that in the first embodiment can be obtained. In addition, the maximum outer diameter of the nose portion 5B (the diameter of the spigot fitted into the attachment hole on the side of the engine in this embodiment) can be further reduced. Accordingly, mounting within the vehicle can be further improved.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A starter comprising:

a motor that generates a turning force;

an output shaft driven by the motor;

a pinion that moves on the output shaft in a direction away from the motor to mate with an internal combustion engine ring gear when the starter is activated, thereby transmitting the turning force transmitted from the output shaft to the ring gear;

a housing for rotatably supporting an end of the output shaft, the end being on a side opposite to the motor with respect to the pinion, the housing including a nose portion for covering an outer circumference of the pinion at least within an axial moving range of the pinion; and the nose portion defining an opening, wherein the opening allows the pinion to mate with the ring gear; and a sealing member defines a tooth profile-shaped hole having approximately the same shape as a tooth profile of the pinion, an outer diameter portion of the sealing member being rotatably supported by an inner surface of the nose portion, a gear portion of the pinion being inserted into the tooth profile-shaped hole so that the sealing member rotates cooperatively with the pinion, wherein the gear portion of the pinion slides inside the tooth profile-shaped hole of the sealing member when the pinion moves on the output shaft in the direction away from the motor, and the gear portion of the pinion is constantly fitted into the tooth profile-shaped hole between a stationary position when the starter is stopped and the pinion maximum moving position along its axial direction.

2. The starter according to claim 1, wherein the sealing member has a cylindrical portion projecting toward the ring gear in the axial direction, the tooth profile-shaped hole is formed in the cylindrical portion, and in the case where an end face of the cylindrical portion on the ring gear side in the axial direction is referred to as an A end face, whereas an end face of the pinion on the ring gear side in the axial direction is referred to as a B end face, when the starter is stopped, the A end face is situated at approximately the same position in the axial direction as that of the B end face or is situated closer to the ring gear in the axial direction than the B end face.

3. The starter according to claim 1, wherein a contact face coming in contact with an outer circumferential portion of the sealing member in the axial direction is provided on an inner side of the nose portion, and convex-concave fitting portions where the contact face and the outer circumferential portion of the sealing member are fitted with each other are provided on the contact face and the outer circumferential portion of the sealing member for their entire circumferences.

4. The starter according to claim 1, wherein the pinion includes a collar portion having a larger diameter than that of the gear portion on the motor side of the gear portion in the axial direction, the collar portion rotates and axially moves with the pinion, the nose portion has a cylindrical shape such that its inner surface shape, at least within an axial moving range of the collar portion, has an inner diameter slightly larger than an outer diameter of the collar portion, wherein the nose portion defines a through hole that brings an inside and an outside of the nose portion in communication with each other at a position within the axial moving range of the collar portion, and wherein the through hole is oriented approximately vertical to a ground surface when the starter is mounted onto a vehicle.

5. The starter according to claim 1, wherein the pinion includes a movable portion, which has a smaller outer diameter than that of the gear portion, on the motor side of the gear portion in the axial direction, that rotates and axially moves with the gear portion, and the pinion, including the movable portion, independently moves on the output shaft when the starter is activated.

6. The starter according to claim 4, wherein the pinion includes a movable portion which has a smaller outer diameter than that of the collar portion on the motor side of the collar portion in the axial direction, and which rotates and axially moves with the gear portion and the collar portion, and the pinion including the movable portion independently moves on the output shaft when the starter is activated.

7. The starter according to claim 1, wherein a surface of the sealing member is subjected to a friction coefficient reducing treatment.

8. The starter according to claim 1, wherein the sealing member is formed of a material having a low friction coefficient.

9. The starter according to claim 1, wherein a gap between the outer diameter portion of the sealing member and the inner surface of the nose portion is filled with a grease.

10. The starter according to claim 1, wherein the sealing member is formed so that an axial thickness of the inner diameter portion including a peripheral edge of the tooth profile-shaped hole is smaller than that of the outer diameter portion supported by the inner surface of the nose portion.

11. The starter according to claim 1, wherein the outer diameter portion of the sealing member is supported by the inner surface of the nose portion using a bearing.

12. The starter according to claim 1, wherein the pinion is fitted by a helical spline on the shaft and is movable on the output shaft along the helical spline, the pinion is operated by a system in which the pinion is moved in a direction opposite to the motor by a turning force of the motor and the action of the helical spline when the starter is activated; and the pinion includes a first conduction circuit for allowing a low current to pass through the motor while the pinion travels on the output shaft to finally mate with the ring gear and a second conduction circuit for allowing a high current to pass through the motor after the pinion mates with the ring gear.

13. The starter according to claim 12, further comprising:

means for regulating the rotation of the pinion before the output shaft is driven by the motor to be rotated, wherein a low current passes through the motor to rotate the output shaft while the rotation of the pinion is being regulated by the pinion rotation regulating means, so that the pinion, which is not rotated, is moved in the direction opposite to the motor.

* * * * *